United States Patent [19]

Barras

[11] Patent Number: 4,717,201

[45] Date of Patent: Jan. 5, 1988

[54] FOLDING CHAIR

[76] Inventor: Lee J. Barras, P.O. Box 73, Gretna, La. 70053

[21] Appl. No.: 818,213

[22] Filed: Jan. 13, 1986

[51] Int. Cl.[4] ..... A47C 4/00

[52] U.S. Cl. ..... 297/16; 297/45; 297/183; 297/17

[58] Field of Search ..... 297/16, 45, 35, 46, 297/47, 183, 17, 51, 52, 39

[56] References Cited

U.S. PATENT DOCUMENTS

| | | | |
|---|---|---|---|
| 398,943 | 3/1889 | Crandall | 297/45 |
| 1,808,201 | 6/1931 | Bauer | 297/39 |
| 2,192,672 | 3/1940 | Connor | 297/35 |
| 2,638,970 | 5/1955 | Harber | 297/39 |
| 2,713,385 | 7/1955 | McQuilken | 297/45 |
| 2,820,509 | 1/1958 | Moreland | 297/183 |
| 2,871,921 | 2/1959 | Arnold | 297/45 X |
| 2,894,564 | 7/1959 | Lorenz | 297/51 |
| 3,000,667 | 9/1961 | Dryden | 297/183 X |
| 3,635,520 | 1/1972 | Roher et al. | 297/45 |
| 4,118,065 | 10/1978 | Watkins | 297/45 |

FOREIGN PATENT DOCUMENTS

| | | | |
|---|---|---|---|
| 1112257 | 11/1955 | France | 297/45 |

*Primary Examiner*—Francis K. Zugel

*Attorney, Agent, or Firm*—Pravel, Gambrell, Hewitt, Kimball & Krieger

[57] ABSTRACT

A folding chair comprises left and right "A" frames which are connected by fore and aft cross braces. Each "A" frame comprises two legs, equal in length, which are pivotally connected at their upper ends. The cross braces are pivotally attached to the legs of the "A" frames at the lower end of the braces, and slidingly connected to the legs at the upper end of the cross braces. The seat and back of the chair are pivotally connected to one another. The chair folds into a bundle having a length substantially equal to that of the legs of the "A" frames.

2 Claims, 9 Drawing Figures

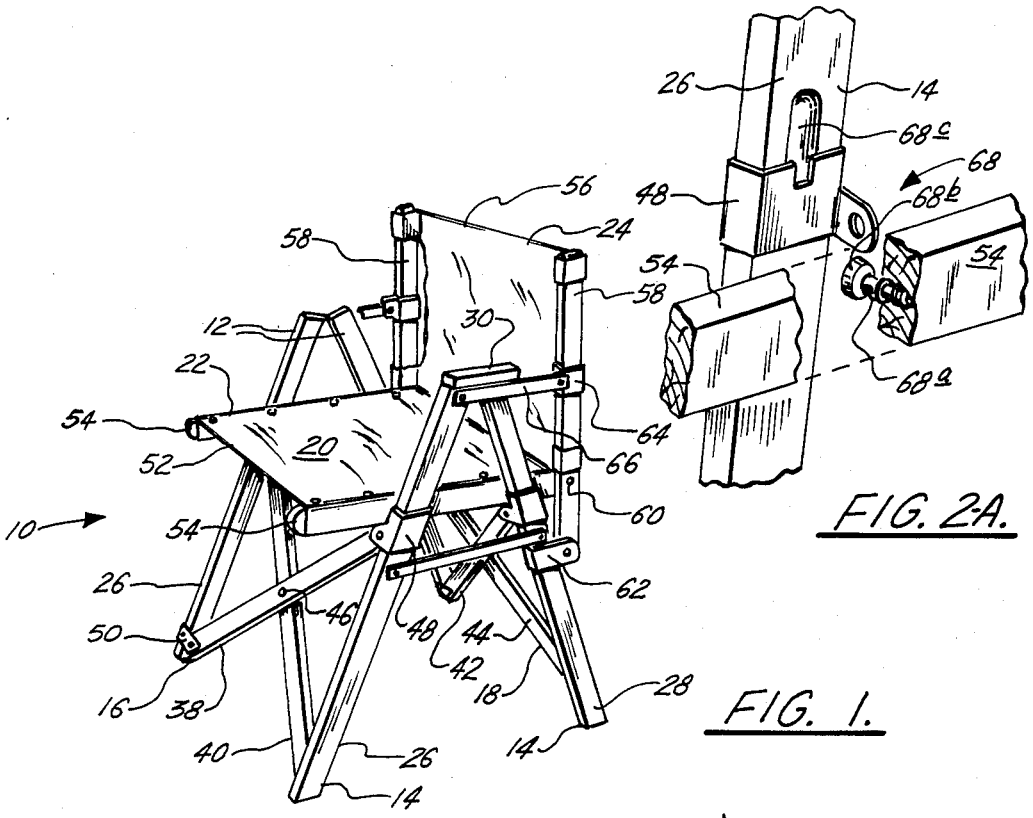
FIG. 2A.
FIG. 1.
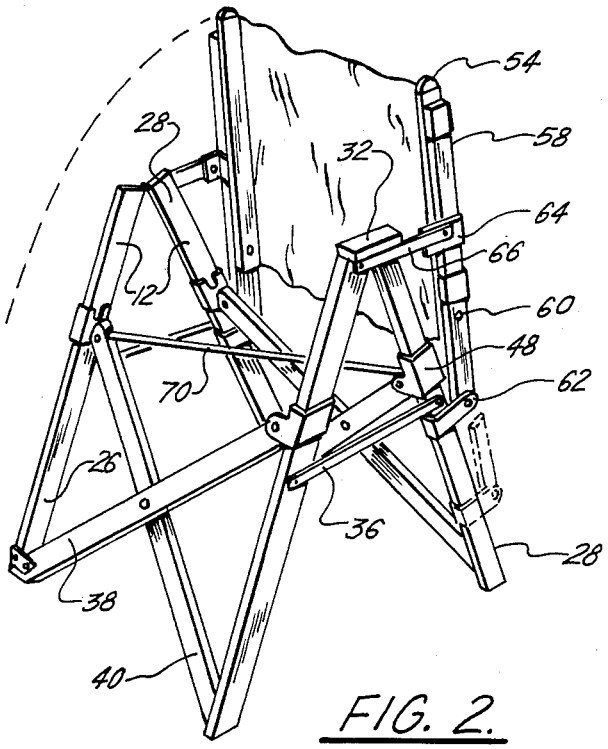
FIG. 2.
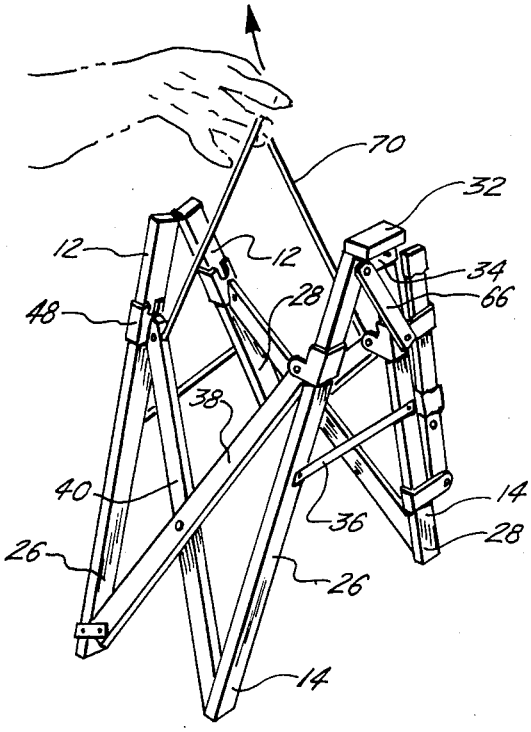
FIG. 3.

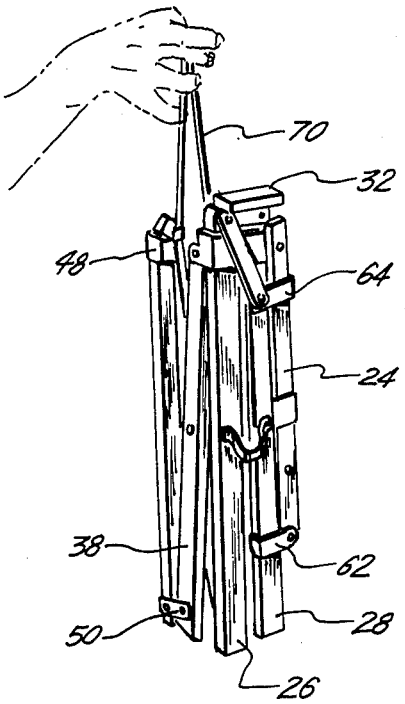
FIG. 4.
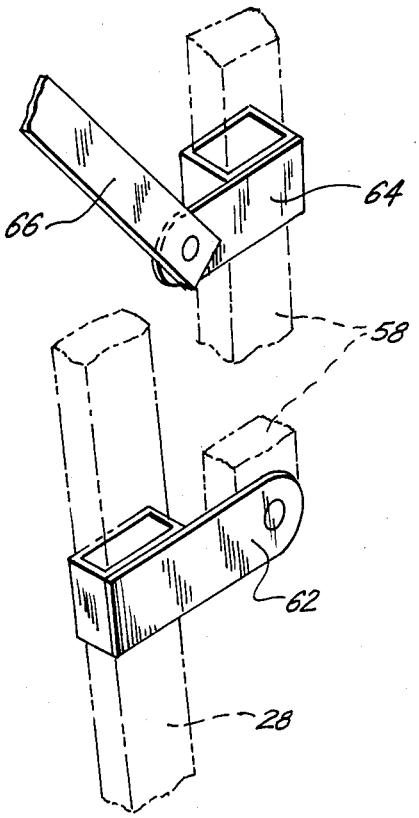
FIG. 4-A.
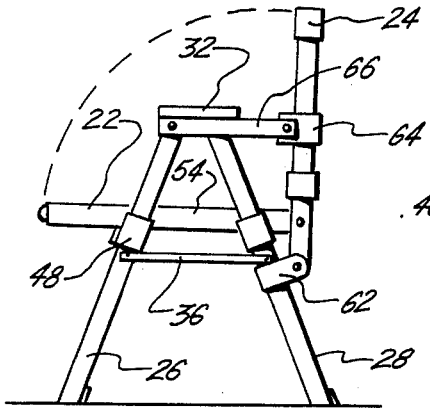
FIG. 5.
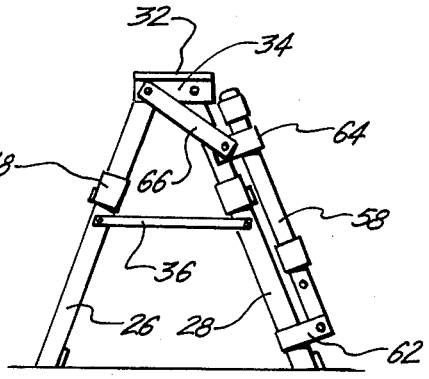
FIG. 5-A.
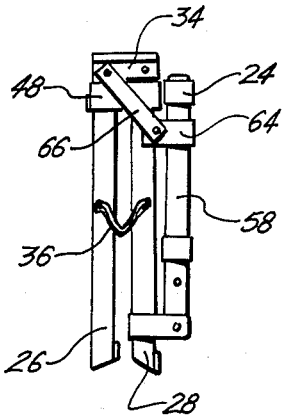
FIG. 5-B.

FOLDING CHAIR

BACKGROUND OF THE INVENTION

This invention relates to portable, collapsible furniture such as might be used for camping, sports events, or furnishing in casual areas of the home. More particularly, the folding chair relates to hinged frame chairs with foldable fabric webs which fold to compact size for storage and transport.

Folding chairs are used in a wide variety os applications whenever seating must be compacted for transport or storage and erected for use in different locations. Folding chairs have proven useful for such activities as camping, viewing parades, and extra seating around the home. Portable folding chairs allow persons of advanced age or those with medical infirmities greater mobility and enjoyment in attending activities away from home simply because personal seating is avalible when desired.

Many types of folding chairs have been developed in the past but have proven to be less than satisfactory due to their uncomfortable nature when erect. Many chairs have small seat or back surfaces which make sitting for even short periods uncomfortable. Often seat and back surfaces of folding chairs are perched upon small base frames which place the occupant in peril of capsize with even the slightest movement. Folding chairs are also difficult to erect or collapse without considerable awkward time consuming effort by one or more persons. Folding chairs which manage to overcome these disadvantages usually fold into unusual shapes which are difficult to transport or store due to their size or loose dangling components. The geometric configuration of a number of folding chairs also fails to allow the use of materials of sufficient size and shape to prevent even slight overloading, unavoidable misuse, or wear from severly damaging the folding or seating characteristics of the chair.

For example, U.S. Pat. No. 1,977,766 teaches the use of a single standard to support the seat and back of the chair. This allows for an awkward seating position due to the manner in which the back must be positioned over the seat. The single standard design further requires that the folded chair be of considerable length for storage and of unstable geometric design.

SUMMARY OF THE INVENTION

The folding chair of the invention solves the aforementioned problems by a unique hinged A frame structure with a seat and back attached to the A frame. The sturcture provides a spacious, comfortable seat and back positioned between the A frames so that the A frames provide an arm rest and enhanced stability. The seat rotates about the A frame to provide compact storage within the length of the A frames. Once the seat is rotated on the A frames the chair may be folded simply by lifting a strap connected to cross bracing between the A frames. During folding, the cross braces pivot and collapse into linear alignment with each A frame which also collapses into lenear alignment. The geometric configuration of the chair allows the strength of materials in each member of the seat, cross bracing and A frames to be used to optimum advantage. This leads to further stability of the chair in the erected position, greater endurance, greater resistance to overloading, and decreased weight.

Collapsible webbing between the A frames prevents the legs of the A frames from spreading beyond a certain distance during erection and use of the chair. Members supporting collapsible material of the seat connect to the A frame on each side when the seat is erected so that the web of the seat will support the weight of a person and retain its erect shape.

The manner in which the A frames, cross bracing, and seat combine provide a chair which is more stable, more easily collapsible, more easily portable, and of a greater strength to weight ratio than other folding chairs.

BRIEF DESCRIPTION OF THE DRAWINGS

A better understanding of the invention can be obtained when the detailed description of the preferred embodiment set forth below is considered in conjunction with the following drawings, in which:

FIG. 1 is a perspective view of the folding chair in the erect position;

FIG. 2 is a perspective view of the folding chair illustrating the manner in which the seat and back pivot on the A frame as the chair is folded;

FIG. 2*a* illustrates the catch between the seat frame members and the legs of the A frame.

FIG. 3 illustrates the manner in which the cross bracing and A frames fold;

FIG. 4 illustrates the chair in the folded position; and

FIG. 4A illustrates the back's sleeves as they attach to the A Frame.

FIG. 5 is a side view of the chair in the erect position.

FIG. 5A is a side view of the chair with the seat and back in position for the chair to be folded.

FIG. 5B is a side view of the chair in the folded position.

DESCRIPTION OF THE PREFERRED EMBODIMENTS

FIG. 1 generally depicts the folding chair 10 of the instant invention. Folding chair 10 has a left 12 and right 14 A frame which are held apart in the erected position by front 16 and rear 18 cross braces. A surface 20 for sitting and the like is made of a seat 22 and back 24 which are pivotally connected to the A frames 12, 14.

A frames 12, 14 are each comprised of a front leg 26 and rear leg 28 which are pivotally connected at the crown on top of each A frame 12, 14. In the preferred embodiment the pivotal connection at the crown of each A frame 12, 14 forms an arm rest 30.

Arm rest 30 has a top surface 32 made of wood or other materials comfortable for use as an arm rest. As illustrated in FIG. 5A, a flange 34 protrudes from the bottom of the upper surface 32 to which the front 26 and rear 28 leg of each A frame 12, 14 is pivotally attached. The A frames 12, 14 and arm rests may be attached to the flange 34 by common means such as threaded nuts and bolts. Webbing 36 is connected between the front 26 and rear 28 leg of each A frame 12, 14 at a preferred position below seat 22. Webbing 36 is a foldable, flexible, generally inextensible material which can be attached to the front leg 26 and rear leg 28 by appropriate means known in the art.

The front cross brace 16, comprises a first member 38 and second member 40. The rear cross member 18 comprises a first member 42 and second member 44. The first 38, 42 and second 40, 44 members of the front 16 and rear 18 cross braces are pivotally connected near-their mid-portions by suitable means such as a nut and bolt 46. The lower end of first member 38 is pivotally connected to the lower end of the front leg 26 of left A frame 12. Similarly, the lower end of second member 40 of front cross brace 16 is pivotally connected to the lower end of the front leg 26 of right A frame 14. Likewise, the lower end of first member 42 is pivotally connected to the lower end of left A frame 12, and the lower end of second member 44 of rear cross brace 18 is pivotally connected to the lower end of the rear leg 28 of right A frame 14.

The upper end of the first members 38, 42 and second members 40, 44 of each front 16 and rear 18 cross member are pivotally attached to the A frame 12, 14 opposite to that which the lower end of each member 38, 40, 42, 44 of the front and rear cross brace 16, 18 is attached. The pivot point at the lower end of each member of the front 16 and rear 18 cross brace may be of any type known in the art which allows rotational movement of the cross brace. However, the pivotal connection at the upper end of each member 38, 40, 42, 44 of the front 16, and rear 18 cross brace must be of a type which allows rotational and linear movement.

For illustrative purposes the front leg 26 of the right A frame 14 and the sleeve-lock 48 attached to the upper portion of the first member 38 of front cross brace 16 will be described. Other upper pivotal connections on each first and second member 38, 40, 42, 44 are the same on the front 16, and rear 18 cross braces.

The pivotal connection at the upper end of each member 38, 40, 42, 44 of the front 16 and rear 18 cross braces comprises a sleeve-lock 48 (see FIG. 2A) that can easily slide up and down a leg of an A frame. The sleeve-lock 48 is pivotally attached to the first member 38 at A Frame 14 at a point where the first member 38 contacts the A frame in the erect position just below seat 22. The sleeve-lock 48 may be connected to first member 38 front leg 26 by appropriate means known in the art such as screws and nuts. Affixing sleeve-lock 48 to the front leg 26 in this manner allows linear movement along the length of leg 26 of the front 16 and rear cross brace as well as rotational movement about pivot point 46, so that as the A frames are moved closer together the cross braces fold to a position sandwiched between and in line with the left 12 and right 14 A frames (see FIG. 3).

The lower end of the first members 38, 42, and the second members 40, 44 of the front 16 and rear 18 cross braces may be attached to their respective legs of the left 12 and right 14 A frames using a shorter bar 50. Shorter bar 50 provides a pivot point between the lower end of the first 38, 42 and second 40, 44 members of the front 16 and rear 18 cross braces and the respective legs 26, 28 of each A frame 12, 14 to which they are attached.

Seat 22 is comprised of foldable material 52 affixed to seat frame members 54. Back 24 is composed of foldable material 56 affixed to two back frame members 58. The seat frame members 54 are pivotally joined to the back frame members 58 by suitable means such as Pin 60. Pin 60 places the pivot point of the seat 22 to the rear of the A frames 12, 14. Back frame members 58 are connected pivotally at the bottom to the rear A frame legs 28 by using lower back sleeve 62 (See FIG. 4A). Lower back sleeve 62 can easily slide up and down A frame leg 28, and is attached to leg 28 by appropriate means known in the art. The back frame members 58 are also connected pivotally to the front A frame legs 26 by using back sleeve 64 (See FIG. 4A). The upper back sleeve can easily slide up and down the back frame member 58. The pivotal connection between upper back sleeves 64 and the front A frame legs 26 comprises an elongated bar 66 (See FIG. 4A). The elongated bar 66 is pivotally connected to the front A frame leg 26 at the front fastener of brace 34 (See FIG. 5 and 5A). Members 58 align with the rear A frame members 28 when the seat 22 and back 24 slide down along the A frame members 28 so the chair may be fully collapsed. Also the elongated bar 66 serves as a supportive member when the chair is erected in keeping the back frame members 58 from moving inward or backward when pressure is applied to the back 24.

Each of the seat support frame members 58 also have a catch 68 which allows each seat frame member to be attached to the front leg 26 and the rear leg 28 of the A frame proximate to each seat support frame member 54. FIG. 2*a* more clearly illustrates lock-catch 68 comprising a large head bolt 68A. The bolt 68A is placed on the seat frame member 54 such that its head 68B will fit into and engage a slot 68C in sleeve-lock 48. A portion of the leg 26 is recessed behind the sleeve-lock 48 in order to accommodate the screw head 68B. The catches 66 retain seat support frame members 54 in a position near the left 12 and right 14 A frame when weight is applied to seat 22 and allow seat 22 to be released so that it will rotate on Pin 60 to the storage position (see FIG. 2).

The rotational alignment of seat frame members 54, back frame members 58, and arm rest 32 should be noted. Arm rest 32 prevents rotation of back support frame members 58 toward the crown of the left 12 and right 14 A frame once the back 56 reaches a generally vertical and upright position. The distance between seat frame members 54 is narrower than the width between the left 12 and right 14 A frames. Seat support members 54 are free to rotate past the crown of left 12 and right 14 A frames to a horizontal position so that they can be locked by catches 68 on the front legs 26 and rear leg 28 of the A frames 12, 14.

In order to fold the chair from the erect position illustrated in FIG. 1 to the compact position illustrated in FIGS. 4 and 5B one initially releases the seat support frame members 54 from sleeve-locks 48 and rotates the seat support frame clockwise as illustrated in FIG. 2. The seat 22 and back 24 as a unit will then slide down the rear A frame legs 28 to the storage position as illustrated in FIGS. 4 and 5A. Note that the length of seat support frame members 54 and back support frame members 58, and cross bracing members 38, 40, 42, 44 is such that in the storage or folded position they do not extend in length beyond the legs 26, 28 of the A frames 12, 14 for compact storage.

A flexible handle 70, extends between opposite members of the front 16 and rear 18 cross braces. As illustrated in FIG. 2, flexible handle 70 extends between the upper portion of the second cross member 40 and the upper portion of the first cross member 42, but may extend between members 38 and 44. Lifting the flexible handle 70 vertically causes the front 16 and rear 18 cross members to collapse into a linear vertical position while drawing the left 12 and right 14 A frames together, and further drawing the front 26 and rear 28 legs of the A frame together. When collapsed, the folding chair assumes the position illustrated in FIG. 4 and 5B.

In order to erect the chair from the collapsed position of FIG. 4 an operator need merely grasp the handles 32 and separate the left 12 and right 14 A frames the maximum width allowed by the front 16 and rear 18 cross braces and the flexible fabric of seat 22 and back 24. The operator then spreads the front legs 26 and rear legs 28 of the A frames 12, 14 to the extent allowed by A frame webbing 36. Finally, the operator lifts the seat 22 and back 24 into the position of FIG. 1, such that back frame members 58 press against arm rest 32 and seat support frame members 54 lock in sleeve-locks 48.

The folding chair as illustrated is composed of wood and fabric materials, and connected by nuts and bolts. However, the foregoing disclosure and description of the invention are illustrative and explanatory, and various changes in size, shape and materials, as well as in the details of the illustrated method of folding and erecting the chair, and details of construction, may be made without departing from the spirit of the invention. All such changes and variations are contemplated as falling within the scope of the appended claims.

What is claimed as invention is:

1. A folding chair comprising:

a. left and right side "A" frames, each comprising front and rear legs which are substantially equal in length and which are connected together at their upper end portios with a pivotal connection;

b. collapsing brace means associated with each side frame for supporting the legs in an unfolded operative position;

c. fore and aft, folding cross braces, each forming connections respectively between the front legs of each side frame and the rear legs of each side frame, the cross brace being pivotally attached to the side frames at the lower end of the cross braces and slidably affixed to the side frames at the upper end of the cross braces so that at the chair folds the cross braces and legs align;

d. a seat supported at its edges upon the side frames when the chair is in an unfolded operative sitting position, the seat being connected to the front and rear legs of the left and right side frames at a point below the pivotal connection of the side frames and above the front and rear cross braces;

e. a back pivotally attached at its side portions to the rear of the seat;

f. sleeve means forming a sliding connection between the bottom edge portions of the back and each rear leg for retaining the lower side portions of the back in two separate, spaced apart positions with respect to the rear legs, including a higher position when the chair is in the unfolded operation position and a lower position near the bottom to the rear legs when the chair is in a folded inoperative storage position; and g. link means connecting the side frames and back for preventing the back from pivoting rearwardly when the chair is in the unfolded operative sitting position, wherein:

the seat and back include foldable fabric material, the legs, back, and seat can collapse into a bundle wherein the legs, cross braces, seat edges, and back side portions are generally aligned parallelt of one another, and the bundle has a length substantially equal to the length of the legs.

2. The folding chair of claim 1, wherein the pivotal connection of the "A" frames include arm rests for an occupant of the seat.

* * * * *